United States Patent [19]

Laucke

[11] 4,096,776

[45] Jun. 27, 1978

[54] RETAINER FOR PUNCH AND DIE SETS

[76] Inventor: Ivan Laucke, 17 Farmstead Rd., #1601, Willowdale, Ontario, Canada

[21] Appl. No.: 822,420

[22] Filed: Aug. 8, 1977

[51] Int. Cl.[2] ..... B26F 1/14

[52] U.S. Cl. ..... 83/698; 279/97

[58] Field of Search ..... 279/97, 87, 86, 76, 279/32; 83/698

[56] References Cited

U.S. PATENT DOCUMENTS

| | | | |
|---|---|---|---|
| 688,860 | 12/1901 | Kay et al. | 279/97 |
| 939,933 | 11/1909 | Trautner | 279/97 X |
| 2,378,806 | 6/1954 | Stellin | 279/97 |
| 2,801,859 | 8/1957 | Kopczynski | 279/86 X |

*Primary Examiner*—J. M. Meister

*Attorney, Agent, or Firm*—Krass & Young

[57] ABSTRACT

A retainer arrangement is disclosed for securing punches, dies or similar machine tool elements within a bore in a tool holder body, the retainer providing for secure and accurately repeatable orientation of the punch or other element within the bore. The retainer comprises a conically tapered pin retainer having a threaded shank portion adapted to be received into a threaded portion of a retainer seat extending into the holder body transversely to the holder bore and having a conically tapered portion partially intersecting the same. The leading end of the tapered pin retainer is tapered to mate with the tapering portion of the retainer seat and with a complementary conical tapered groove formed in the punch shank, to securely retain the punch or other machine element within the holder body, and also to precisely and repeatably orient the same with respect to the holder body bore in receiving the same. The geometry of the mating retainer pin, groove and tapering portion of the retainer seat is such as to insure seating of the pin in the groove to provide firm engagement with the machine tool element. Also disclosed is the alternate provision of opposed pairs of the tapered pin retainers for heavy duty applications or a single retainer for light duty applications. In one embodiment, the axis of the retainer is inclined from the normal to the tool axis to facilitate removal thereof. The punch shank is disclosed as being formed with a series of ratchet cuts formed along the longitudinal length thereof to facilitate removal of the punch by means of a screw driver or similar tool, while the tool holder backing plates are formed with recesses for easy removal from the press arm members.

13 Claims, 7 Drawing Figures

Fig-1
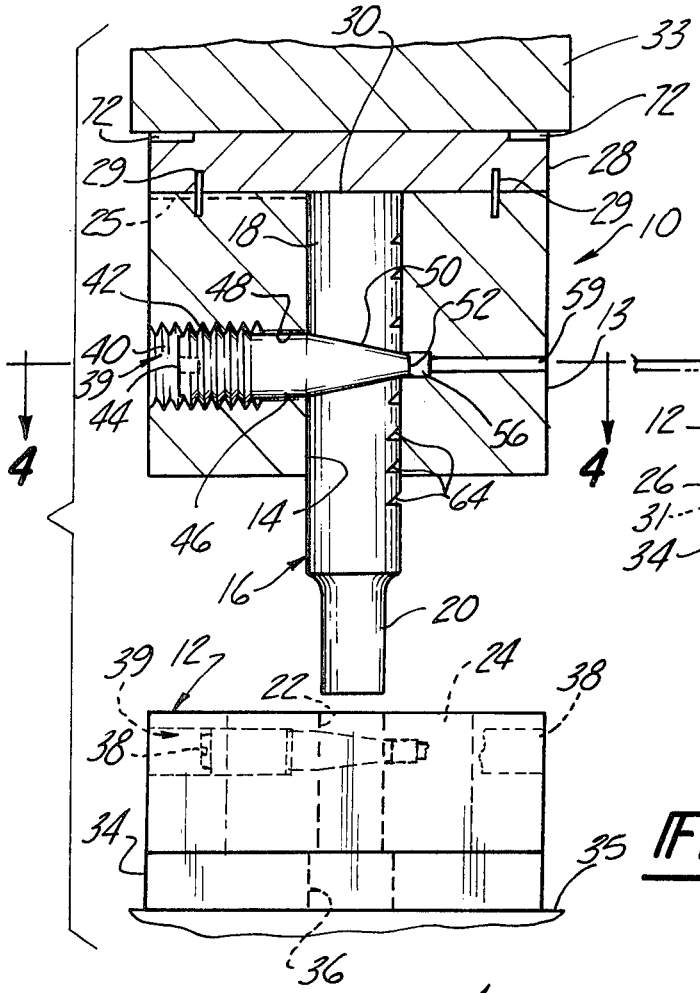
Fig-2
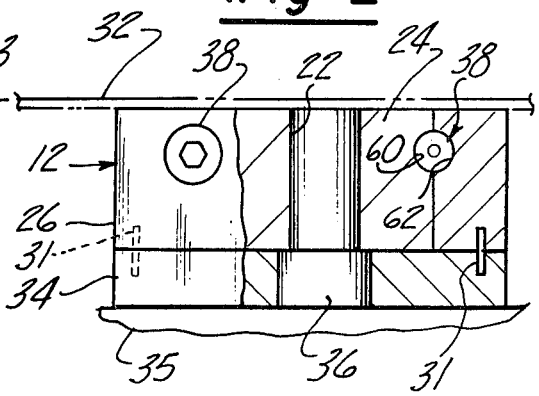
Fig-3
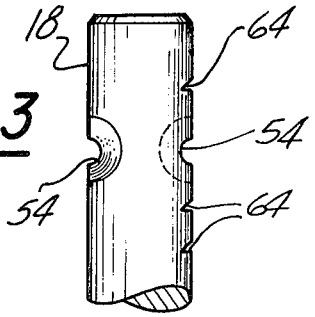
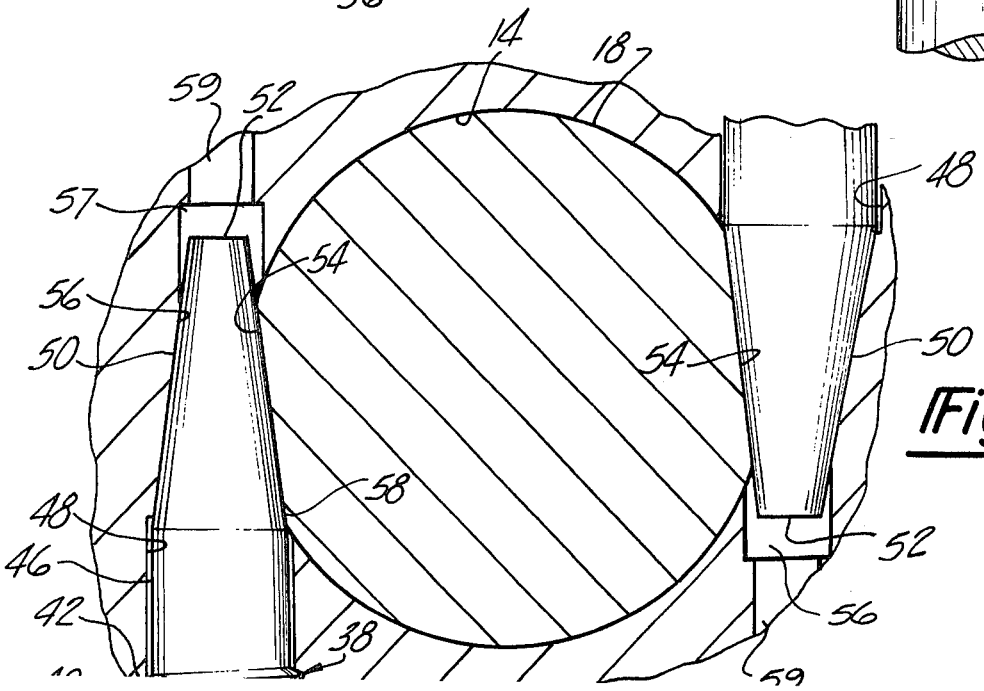
Fig-4

RETAINER FOR PUNCH AND DIE SETS

BACKGROUND OF THE INVENTION

1. Field of the Invention

This invention concerns retainer arrangements and more particularly, retainer arrangements adapted to secure machine tool elements, such as punches and dies within a holder body structure formed with a bore to receive the machine tool element.

2. Description of the Prior Art

In many machine tool applications, such as in punch and die sets, it is often necessary to releasably secure a machine tool element, such as the shank of a punch within a bore formed in a tool holder body. In the so-called "headless" punch sets the punch shank is received within a bore in a holder body and seated against a backup plate which is doweled and screwed or bolted to the holder body. The backup plate serves to absorb the brunt of the thrust of the punch, as the punching operation is carried out. As the punch withdraws from the stock through which the hole has been formed, a considerable withdrawal drag may be exerted on the punch, acting to tend to strip the punch from its holder, necessitating the use of a relatively secure retainer arrangement associated with the retainer block which acts to resist the stripping forces.

In addition, for irregularly shaped punches, it is necessary that the orientation of the punch within the bore be preserved very accurately and to be repeatable upon insertion and removal of the punch tool from the holder body, so as to properly position the punch with respect to the die and workpiece.

Further, the forces exerted on the punch during operation of the press are usually quite considerable and any such retainer arrangement should be capable of absorbing these forces (in conjunction with the backup plate) without allowing the punch to shift or creating damage to the retainer arrangement itself.

A retainer arrangement which has been in widespread use due to the speed with which punches or dies can be changed utilizes a spring loaded ball engaging a locating relief machined on the shank of the punch or die. While this approach has enjoyed great success, it is limited in the accuracy of radial location which may be achieved, is not adapted to heavy duty applications and also is very inconvenient during setup.

That is, setup of a punch and die set involves manual movement of the punch in the holder to carry out alignment with the die opening. The above-described retainer arrangement requires disassembly of the punch retainer during setup to free the punch and reassembly after, an obviously time consuming and inconvenient procedure.

One prior art approach to providing such a retainer arrangement which overcomes these problems is disclosed in the Whistler, Sr. et al U.S. Pat. No. 3,137,193 which shows an arrangement which is intended to securely retain the punch and die within their respective holder body structures. However, the arrangement disclosed in that patent involves a two-part assembly having two different elements of complex configuration to provide the results described, which is of relatively high cost to fabricate.

Other examples of similar approaches are disclosed in the Whistler Sr. U.S. Pat. No. 3,535,967 and the Bennett U.S. Pat. No. 3,640,170, both of which also include complexly configured two-element retainer arrangements. This complexity would considerably increase the cost of the punch and die sets in which these retainer arrangements are incorporated.

In the Kobzinski Patent No. 2,801,859 is disclosed a one-piece tapered screwlock type retainer for use as a punch retainer arrangement. While considerably simplifying the retainer arrangement, substantial drawbacks are still encountered in the Kobzinski approach.

Firstly, the threaded leading portion is of relatively small diameter with respect to the diameter of the tapered pin, and since certain thrusting forces exerted on the punch may be transmitted into the threaded portion, breakage of the threaded portion would appear to be a troublesome potential problem with this design. Removal of the broken threaded portion from the bore within which the threaded leading portion is received would necessitate time-consuming and tedious removal resulting in considerable down time for the machine utilizing the punch and die set. Further, the arrangement does not assure the proper seating of the tapered pin with respect to the cooperating groove on the punch shank and a tapered groove in the holder body, so as to provide proper engagement of the tapering sides of the pin and the tapering opening formed in the retainer block, without extraordinary precision in machining such as would render its manufacture impractical.

Other related problems are encountered during disassembly of the punch retainers from the press ram and the punch from the tool holder body, since sticking of the dowels and the punch in their respective bores is common. Since the dowels are sometimes fitted into blind holes and the punch is often removed without access to its rear face, driving the dowels or punches out is not possible.

It has been heretofore provided for "puller" arrangements for removal of such backing plates but these arrangements add significantly to the complexity and cost of the die set and also are relatively time consuming to employ.

Accordingly, it is an objective of the present invention to provide a retainer arrangement suitable for securing machine tool elements, such as punches and die sets within bores formed in tool holder bodies or other structures which allows for accurate and repeatable orientation of the element within its holder body.

It is a further objective of the present invention to provide such a retainer arrangement in which a very secure, shake-proof retention of the machine tool element is assured and which is capable of absorbing relatively large loadings without failure, and without loss of the accurate positioning of the machine tool elements.

It is yet another objective of the present invention to provide such a retainer arrangement involving only a single part of relatively simple configuration so as to not add unduly to the manufacturing costs of the associated punch and die sets or other machine tool elements involved.

Another objective is to provide a retainer arrangement which is convenient to use during setup and alignment of the punch and die sets.

These objectives are sought to be achieved while rendering the quick change convenience of prior art retainers allowing rapid changeover as in progressive die sets.

Additional related features which allow convenient disassembly of the various punch and die components are also sought to be provided.

SUMMARY OF THE INVENTION

These and other objects of the present invention are accomplished by means of a tapered pin retainer extending into a retainer set extending transversely to the tool holder bore cooperating with a conically tapering groove formed on the machine tool element retainer and configured so that a tapered pin when advanced by the engagement of a threaded portion of the retainer within a threaded portion of the retainer set, seats on the groove portion of the machine tool element and a tapered portion of the retainer seat formed in the holder body to securely retain the machine tool element within the holder body bore. This orientation is capable of being maintained, even though relatively heavy loads are imposed on the machine tool element and is capable of absorbing these loads without damage. The nature of the engagement of the tapered portion of the retainer pin with the groove and the tapered portion of the retainer seat is such as to insure firm seating against the groove to provide firm engagement with the machine tool element.

Two of these tapered pin retainer arrangements are utilized in opposing relationship to increase the load carrying abilities of the retainer arrangement in heavy duty applications, but a single retainer arrangement may alternatively be utilized. An inclined axis orientation of the retainer may also be provided to facilitate removal.

This arrangement allows quick and convenient release of the punch or die for both setup and changeover.

Additionally, recesses are provided on the punch shank and intermediate the backing plate for prying loose the punch from the bore and the punch retainer from the doweling locating the punch retainer to the punch ram or die shoe.

DESCRIPTION OF THE DRAWINGS

FIG. 1 is an elevational view in partial section of a punch and die set utilizing a retainer arrangement according to the present invention.

FIG. 2 is a partially sectional view of the die set shown in FIG. 1.

FIG. 3 is a fragmentary view of the punch shank having a configuration adapted to cooperate with the retainer arrangement, according to the present invention.

FIG. 4 is an enlarged plan view of two opposing tapered pin retainers engaging the tapered portion of respective retainer seats and partially cylindrical grooves formed in the punch shank.

DETAILED DESCRIPTION

Figure 5:
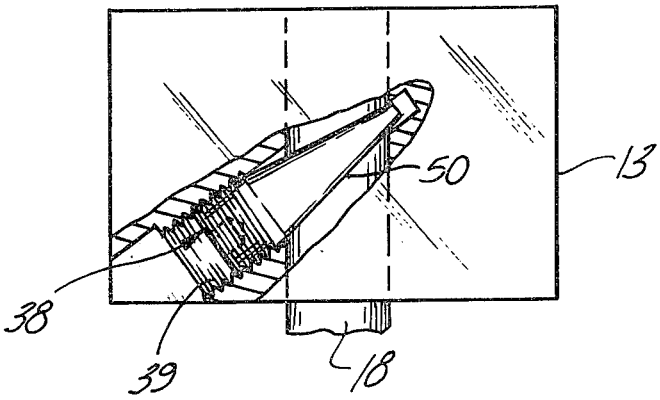
FIG. 5 is an elevational view of a punch and holder in partial section utilizing an alternate embodiment of the retainer arrangement according to the present invention.

In the following detailed description, certain specific terminology will be utilized for the sake of clarity and a specific embodiment described in accordance with the requirements of 35 USC 112, but it should be understood that the same is not intended to be limiting and indeed should not be so construed inasmuch as the invention is capable of many forms and being variously embodied within the scope of the appended claims.

Referring to the drawings, and particularly FIGS. 1 and 2, the retainer arrangement according to the present invention is described in conjunction with a punch and die set including a punch assembly 10 and a die assembly 12, shown in FIG. 1.

The punch assembly 10 includes a punch holder body 13, which is formed with a punch received bore 14 into which is slip fitted or wring fitted a punch 16 having a shank portion 18 and a cutting portion 20 integral therewith and having a configuration adapted to mate with a die opening 22 formed in a female die 24 included in the die assembly 12, the female die 24 being secured within a die holder body 26.

The punch assembly 10 also includes a hardened backing plate 28 which the end portion 30 of the punch shank 18 is adapted to abut, so as to absorb the thrust of the reaction to the cutting action when the cutting portion 20 of the punch 16 penetrates the workpiece, shown in phantom at 32. The backing plate 28 is located during assembly to line up the mounting screw holes by locating pins 29 pressed into holes in the backing plate 28.

The die opening 22 and the cutting portion 20 of punch are configured to mate and it is for this reason that if the cutting portion 20 and the die opening 22 are irregularly shaped, the angular orientation of the punch and die both must be set with considerable precision to insure proper mating of the punch cutting portion 20 therein.

An air vent groove 25 is provided to facilitate seating of the punch 18 in the bore 14.

The female die 24 in similar fashion has a backing plate 34 secured to the die holder body 26 to retain the die 24 within the die holder body 26. An opening 36 may be provided to receive the slugs punched out from the workpiece 32.

The punch assembly 10 is normally affixed to a ram mechanism 33 forming a part of the punch press, shown partially in FIG. 1.

Similarly, the die set 12 would be positioned on the lower plate or bed 33 of the punch press, partially shown in FIG. 1.

In the embodiment shown in FIGS. 1 through 4, a double opposed retainer arrangement according to the present invention is incorporated which is suitable for heavy duty applications. Each retainer includes a taper pin retainer 38 which is threadably received within a threaded portion 40 of a retainer seat 39 machined into the punch holder body 13 and extending transversely to the axis of the punch receiving bore 14. The taper pin retainer 38 has formed on its trailing portion thereof a threaded body section 42 which mates with the threaded portion 40. A hex recess 44 is formed in the rear face of the taper pin retainer 38 to enable the advancement thereof by means of an Allen wrench or other similar tool.

The taper pin retainer 38 also has a straight-sided portion 46 extending through a corresponding straight-sided section 48 of the retainer seat 39, aligned with the threaded bore 40.

The taper pin retainer 38 has a leading portion which is formed with a non-jamming conical taper section 50 such as is provided by a Jarno taper terminating in an end face 52. The taper section 50 mates with a partially conical circular in section, complementarily tapered conical groove formed in the punch shank 18, shown in FIG. 4 at 54, and also a complementarily tapered portion 56. A straight-sided bore 57 is provided forming the terminus of the retainer seat 39 into which the end face 52 protrudes.

Proper engagement between the tapered section 50 and the groove 54 is critical in order that the taper pin retainer 38 should function to securely engage to locate the punch shank 18. The proper geometric relationship of the parts creating this engagement is appreciated by reference to FIG. 4 which is enlarged to render clear these details. Essentially, this engagement is produced by simultaneous seating only on one side of the taper pin retainer 38 on the groove 54 and the other on the tapered portion 56 of the seat 39 so that both surfaces are forcefully engaged by the taper section 50.

The straight-sided section 48 is provided with a clearance between the straight-sided extension portion 46 and the bore 48 so that the taper pin retainer 38 will not lock on the sidewall of the clearance portion 48 if slight lateral shifting occurs as the taper pin retainer 38 seats. Thus, a slight amount of tilting can take place, accommodated by the clearance space, to insure that the taper section 50 can move to fully engage the groove 54.

It is also essential that the taper section 50 only engage the tapered groove 54 on the half of the upper section 50 in engagement therewith to insure seating of this half on the tapered groove 54. This is accomplished by insuring that the diameter of the bore 57 is great enough to provide a clearance between the taper section 50 and the straight bore 57 upon full advance of the taper pin retainer 38 into the retainer seat 39. The net effect of the provision of the straight-sided portions 46 and 57 of suitable diameter is to create a clearance between the pin retainer 38 and the retainer seat 39 in the regions thereof immediately adjacent the intersection of the conically tapered section 50 of the bore 14. Thus, this insures proper seating of the pin 38 on the partially conical groove 54.

Thus, as the taper pin retainer 38 is advanced into the retainer clearance passage 39, it necessarily firmly engages tapered groove 54 and is seated thereon. Full advance of the tapered pin retainer 38 at the same time firmly wedges the taper section 50 between the tapered portion 56 on the one side and the tapered groove 54 on the other so that the punch shank 18 is very tightly retained within the holder body 13 and in a repeatably accurate, pre-determined angular orientation in the punch retaining bore 14.

The taper section 50 also insures that the punch is securely positioned abutting the backup plate 28, due to the two-axis locating function of the taper cooperating with the tapered groove 54, so that very secure shakeproof retention is accomplished.

A knock-out passage 59 may be provided to loosen the taper pin retainer 38 as with tapping an inserted rod in the event very tight wedging has occurred.

As noted, in heavy duty applications, it is contemplated that there be provided two of the taper pin retainers 38 of similar configuration as shown in FIGS. 1 through 4, cooperating with similarly configured taper grooves and retainer seats 39 located on either side of the axis of the bore 14 and punch shank 18 and extending in opposing directions. This increases the retention force available by a factor of 2 insuring the very solid retention thereof necessary in the heavy duty applications, such as are common in the automotive industry.

The die assembly 12 is similarly provided with taper pin retainer elements 38, and partially circular in section tapered grooves 60 formed in the die 24 and tapered portions 62 of retainer seats 63 formed in the die holder body 12 to retain the die 24 in similar fashion.

Figure 6:
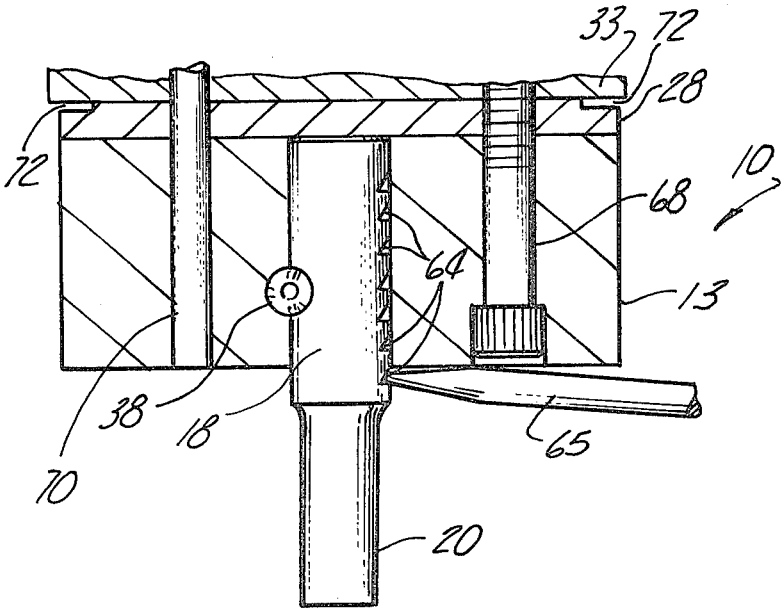
FIG. 6 is a partial section of an elevational view of the alternate punch retainer arrangement showing the cap-screw and doweling of the assembly to the punch ram, and the mode of engagement of a screwdriver with the punch shank in removing the punch.
Figure 7:
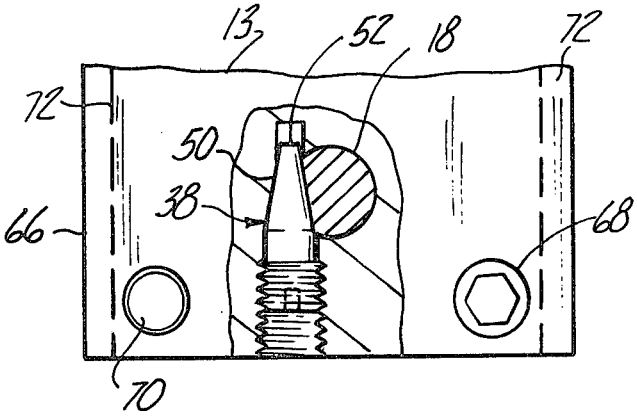
FIG. 7 shows a fragmentary plan view of the punch retainer arrangement shown in FIG. 6.

However, in light duty applications, a single retainer may be utilized as shown in FIGS. 5 through 7.

In FIG. 5, the axis of taper pin retainer 38 and retainer seat 39 is inclined from being normal to the axis of punch 18 as described in the above embodiment. This facilitates removal of the taper pin by virtue of its easy accessability.

The punch shank 18 may also be provided with a series of milled, ratchet cuts 64 extending along the axial length thereof, as shown in FIG. 1. These cuts are provided to enable removal of the punch 16 in those instances where the punch 16 is retained rather tightly within the punch receiving bore 14 as for fine blanking operations.

As seen in FIG. 6, a screwdriver 65 may thus be utilized to pry the punch 18 loose from the holder body 13.

As described above, it often becomes necessary to loosen the holder body 13 from the punch ram 33 since, in addition to capscrews 68, dowels 70 are utilized passing through the punch holder body 13 and the backing plate 28, typically into blind holes machined into the punch ram 33. For easy removal, recesses 72 are thus provided in the upper surface of the backing plate 28 which allows prying engagement with the screwdriver 65.

The precision orientation and repeatability afforded by this retainer arrangement allows the use of the punch holder body 13 as a fixture for machining one of the surfaces 66 into precise parallelism with the retainer axis, whereby punch after punch may be seated successively with the surface 66 used to locate the punch with respect to the grinder or other machine tool.

Thus, it can be appreciated that by this relatively simple, easily manufactured arrangement, a precision heavy duty retainer has been provided, which allows quick change of the punch or dies with a highly repeatable positioning thereof, and also allows ready release for convenient setup procedures.

In addition, certain other difficult disassembly steps have been rendered easy, i.e., by the milled ratchet cuts in the punch, the recesses in the backing plate, and the knock-out passage associated with the retainer seat.

The precision repeatability allows the use of the holder as a machining fixture.

Many variations of the specific designs disclosed are of course possible within the scope of the following claims.

The embodiments of the invention in which an exclusive property or privilege is claimed are defined as follows:

1. A retainer arrangement for securing a member within a bore formed in a holder body structure, the retainer arrangement comprising:

a pin retainer having a conical tapered portion and a threaded portion integral with the large end of said tapered portion, said tapered pin retainer disposed within a retainer seat formed in said holder body extending tranversely to said bore in said holder body, said retainer seat having a threaded portion engaging said threaded portion on said taper pin retainer and a conically tapered portion complementary to said taper portion on said taper pin retainer partially intersecting said bore in said holder body, and a partially conical tapered groove formed on said member and complementarily shaped to said conically tapered portions of said retainer pin and said retainer seat adapted to be engaged by said pin retainer tapered portion as said pin retainer is advanced into said retainer seat by said threaded engagement of said threaded portion of said pin with said threaded portion of said retainer seat.

2. The retainer arrangement according to claim 1 wherein a substantial clearance space is provided between said taper pin and said retainer seat in the regions of said seat adjacent said intersection of said tapered portion of said retainer seat with said bore.

3. The retainer arrangement according to claim 3 wherein said clearance space is provided by a straight-sided clearance opening formed along said retainer seat extending into partial intersection with said element receiving bore on either side of said tapering section of said retainer seat.

4. The retainer arrangement according to claim 1 further including a second pin retainer having said tapered and threaded portions disposed in a second retainer seat formed in said holder body and a second tapered groove formed in said element and with said tapered portions extending oppositely to said pin retainer tapered portion.

5. A punch or die retainer arrangement for securing a tool within a bore formed in a tool holder body structure, the tool retainer arrangement comprising:

a pin retainer having a conically tapered portion, a straight-sided portion integral with said tapered portion and a threaded portion integral with said straight-sided portion opposite said tapered portion, said pin retainer disposed within a retainer seat formed in said holder body extending transversely to said bore in said holder body, said retainer seat having a threaded portion engaging said threaded portion on said taper pin retainer, a tapered portion complementary to said taper portion on said taper pin retainer, and partially intersecting said bore in said holder body, and an intermediate straight-sided portion between said threaded and tapered portion adapted to receive said straight-sided portion of said pin retainer; and, a partially conical taper groove formed on said tool and complementarily shaped to said tapering portions of said pin retainer and said retainer seats to be engaged by said pin retainer taper portion as said taper pin retainer is advanced into said retainer seat by said threaded engagement.

6. The tool retainer arrangement according to claim 5 wherein substantial clearance space is provided between said intermediate straight-sided portions and said intermediate portion of said pin retainer.

7. The tool retainer arrangement according to claim 6 wherein said configuration is provided by extension of said intermediate straight-sided portion of said retainer seat into partial intersection with said bore.

8. The tool retainer arrangement according to claim 5 further including a surface on said tool holder body precision machined to be in parallel with the axis of said retainer seat machined in said holder body, whereby said holder body may be utilized as a fixture in machining a plurality of identical tools.

9. The tool retainer arrangement according to claim 5 further including a plurality of cuts disposed along the axis of said tool received within said bore, whereby said tool may be removed by engagement with said cuts.

10. The tool retainer arrangement according to claim 5 wherein said retainer seat further includes another straight-sided portion adjacent said tapered portion opposite said straight-sided portion, said straight-sided portions intersecting said bore, said tapered portion of said pin retainer extending into said another straight-sided portion with a clearance therebetween.

11. The tool retainer according to claim 10 wherein said retainer seat further includes a knock-out passage extending through said tool holder body into said another straight-sided portion.

12. The tool retainer according to claim 5 wherein said retainer seat extends along an axis at an angle intermediate normal to said bore axis.

13. The tool retainer according to claim 5 wherein said holder body includes a backing plate affixed by dowels and capscrews to said holder body and recesses formed in the periphery of said backing plate whereby said backing plate may be loosened by engagement of said recesses.

* * * * *